US007006047B2

(12) United States Patent
Marsan et al.

(10) Patent No.: US 7,006,047 B2
(45) Date of Patent: Feb. 28, 2006

(54) COMPACT LOW RCS ULTRA-WIDE BANDWIDTH CONICAL MONOPOLE ANTENNA

(75) Inventors: Lynn A. Marsan, Brookline, NH (US); Edward A. Urbanik, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/728,352

(22) Filed: Dec. 3, 2003

(65) Prior Publication Data

US 2005/0122274 A1 Jun. 9, 2005

(51) Int. Cl.
*H01Q 1/28* (2006.01)
*H01Q 13/00* (2006.01)

(52) U.S. Cl. ..... 343/705; 343/708; 343/772; 343/773; 343/786

(58) Field of Classification Search ..... 343/705, 343/708, 718, 824, 772, 773, 786
See application file for complete search history.

(56) References Cited

U.S. PATENT DOCUMENTS 3,401,387 A * 9/1968 Milligan et al. ..... 343/767
4,074,268 A * 2/1978 Olson ..... 342/399
4,719,699 A * 1/1988 Dash et al. ..... 30/90.1
4,851,859 A * 7/1989 Rappaport ..... 343/790
5,038,152 A * 8/1991 Wong et al. ..... 343/756
5,523,767 A * 6/1996 McCorkle ..... 343/810
6,268,834 B1 * 7/2001 Josypenko ..... 343/773
6,593,892 B1 * 7/2003 Honda et al. ..... 343/773
6,693,600 B1 * 2/2004 Elliot ..... 343/773
6,845,253 B1 * 1/2005 Schantz ..... 455/575.7
2002/0089463 A1 * 7/2002 Jung ..... 343/786
2003/0016181 A1 * 1/2003 Engargiola ..... 343/792.5
2003/0227412 A1 * 12/2003 Stewart ..... 343/705
2005/0140557 A1 * 6/2005 Kurode et al. ..... 343/773

OTHER PUBLICATIONS

PCT International Search Report dated Nov. 8, 2004 of International Application No. PCT/US04/02127 filed Jan. 22, 2004.

* cited by examiner

*Primary Examiner*—Thuy V. Tran
*Assistant Examiner*—Leith Al-Nazer
(74) *Attorney, Agent, or Firm*—Daniel J. Long; Robert K. Tendler

(57) ABSTRACT

A low radar cross-section monocone antenna is provided with an ultra-wide bandwidth in the microwave region of the electromagnetic spectrum running from 1 gigahertz to 18 gigahertz by decreasing the low frequency cutoff through enlarging the overall dimensions of the cone while at the same time maintaining the base diameter of the apex of the cone to the initially-set dimension that establishes the high frequency cutoff of the antenna. The apex of this cone that serves as its feed point has a base diameter that results in the wide bandwidth, with the monocone antenna having a 5 dBi gain and omnidirectional coverage.

6 Claims, 7 Drawing Sheets

COMPACT LOW RCS ULTRA-WIDE BANDWIDTH CONICAL MONOPOLE ANTENNA

FIELD OF THE INVENTION

This invention relates to ultra-wide band microwave antennas and more particularly to the utilization of a monocone configured to have high gain with an 18:1 frequency ratio.

BACKGROUND OF THE INVENTION

Typical aircraft-mounted microwave antennas utilized, for instance, for detecting incoming missile radars, have in large part been configured as slot antennas within the wing or fuselage of an aircraft; or have involved so-called Vivaldi notch antennas used primarily for their ultra-wide bandwidth.

The problems with the slot antennas are, first and foremost, that the aircraft wing or fuselage must be specially configured or formed so as to house or carry the slot antenna. Oftentimes these antennas are spaced along the edge of the wing and the wing is provided with a so-called wing glove to protect the antennas from environmental erosion, including rain and particle erosion. The wing gloves are also utilized to maintain the appropriate airflow across the wing so as to eliminate turbulences which could be caused with an open slot.

Moreover, when Vivaldi notch antennas are utilized, at the higher frequencies these antennas are highly directional with a very narrow antenna lobe that in some cases precludes their use as an antenna to detect missiles coming in from all directions. While incoming missiles are provided in most instances with infrared seekers, they are first directed to the target aircraft through the utilization of microwave radar. It is therefore important to be able to detect an incoming missile from any direction and to provide sufficient countermeasure radiation to cause the missile to go off-target. It is also important that the antenna have a low radar cross-section, RCS, to avoid detection.

The microwave region of the electromagnetic spectrum is usually said to include 1 gigahertz frequencies up to 18 gigahertz, which requires an 18:1 frequency ratio of high frequency cutoff to low frequency cutoff. Slot antennas, on the other hand, usually have a 3:1 ratio and as a result, numbers of antennas are required tuned to adjacent bands so as to provide the required wideband coverage.

Moreover, Vivaldi notch antennas, while providing ultra-wide bandwidth due to the Vivaldi notch structure, are exceptionally directional. Moreover, they do not provide adequate gain across their entire bandwidth.

There is therefore a need for a robust low RCS ultra-wideband antenna having an omnidirectional radiation pattern in which the gain of the antenna is better than unity across the entire bandwidth. Not only are these antennas to be useful in surveillance, the antenna must also be useable in a transmit mode to provide a maximum amount of power on target. This in general voltage standing wave ratio, means that the VSWR of the antenna across its entire bandwidth must be less than 2:1.

Additionally, the antenna should be capable of handling high powers and should be able to handle at least 100-watt CW at the frequency of interest.

Such antennas are also required, for instance, for IFF purposes in which identification of friend or foe requires their use in a transponder-like environment. This means that the antenna must be ultra-wideband, have the same omnidirectional antenna characteristics as described above and must be relatively efficient across the entire bandwidth.

It is important that the antenna be as omnidirectional as possible and in general have a pattern associated with a monopole antenna and a ground plane.

By way of further background, if one utilizes a double cone or discone, the radiation pattern for these antennas is a dipole pattern which is not useful in detecting missiles coming up from directly beneath an aircraft because the missile will be in an antenna null. It is also important that, as is usual, one wants to look at the horizon and it is therefore important to have a major 360° lobe in the horizontal direction.

Note that U.S. Pat. No. 6,346,920 shows a broadband fan cone direction finding array in which the radiator has a partial cone shape. This type of antenna is not applicable to the above-mentioned applications and is for a different purpose altogether. Also, it will be appreciated that the major operating frequency of these antennas is between 200 MHz and 3 gigahertz, with the cones themselves being fabricated through the utilization of wires. Additionally, these cones are arrayed so as to provide direction finding capabilities in the VHF/UHF/SHF bands. As can be seen from this patent, both monocones and bicones are described as prior art in this patent. It is noted in this patent that when these conical antennas are arrayed, their radiation patterns tend to interfere with each other, which complicates direction finding processes.

U.S. Pat. No. 6,198,454 describes a similar fan cone direction finding antenna array, whereas U.S. Pat. No. 4,835,542 describes an ultra-wide band linearly polarized biconical antenna.

A biconical dipole antenna is described in U.S. Pat. No. 5,367,312, with the antenna being implemented through the use of wires distributed around a rod to define a conical cavity around each of the rods.

Finally, U.S. Pat. No. 5,068,671 describes an orthogonally polarized quadrophase electromagnetic radiator which has airfoil-shaped elements to define a horn and which has a ground plane member which is preferably a truncated conical shape.

None of these antennas describe a monocone over a ground plane, much less a way of providing an ultra-wideband response to a monocone, which also provides an omnidirectional pattern and high gain.

SUMMARY OF INVENTION

The above problems of slot and notch antennas are solved by providing an ultra-wideband antenna having an 18:1 ratio, an omnidirectional antenna pattern and a gain of 5 dBi over the entire range by providing a monocone over a ground plane. The antenna is a low radar cross-section antenna and is fed at the apex of the cone, with the apex base diameter being small enough to create an 18 MHz high frequency cutoff. The low frequency of the cutoff of the cone-shaped antenna is decreased by providing an increased size cone. The high frequency cutoff of the antenna is provided by making the base diameter of the apex of the cone the same as that associated with the highest frequency of interest, regardless of how much the size of the cone is increased to decrease the low frequency cutoff. The low frequency cutoff is thus a function of the diameter of the top of the cone and the height of the cone. Note that the desired omnidirectional antenna monopole pattern is provided by locating the cone above or below a ground plane. In one embodiment the cone is a solid brass structure which may be conical or frustoconical or may have pyramid-type sides. It is important, however, that the base diameter of the apex of the cone be such as to support the high frequency cutoff and should not be enlarged with the enlargement of the remainder of the antenna to establish a low frequency cutoff.

The monocone antenna has application in missile threat detection systems to protect aircraft against incoming missiles without having to reconfigure a wing or use conformal wing-glove protection, with the omnidirectional coverage of the antenna eliminating the problems with the narrow lobe of notch-type antennas used in the past. The small monocones are unobtrusive when mounted to a fuselage or wing and may be utilized as IFF C-band antennas for identification of friend or foe or as instrument landing systems antennas. When these antennas are spaced along a wing one can obtain long baseline interferometry so as to obtain a rough estimate of the direction of a microwave source, with the antennas acting as point sources for each location along the wing. Additionally, the monocones have an up to 100-watt CW rating and are extremely low cost, since neither the wings nor fuselage of the aircraft need be specially configured to house the antennas. As a result, the antennas can be sprinkled liberally over the aircraft, with the antennas being ultra-wide bandwidth, small, high gain, omnidirectional antennas.

In summary, a monocone antenna is provided with an ultra-wide bandwidth in the microwave region of the electromagnetic spectrum running from 1 gigahertz to 18 gigahertz by decreasing the low frequency cutoff through enlarging the overall dimensions of the cone while at the same time maintaining the base diameter of the apex of the cone to the initially-set dimension that establishes the high frequency cutoff of the antenna. The apex of this cone that serves as its feed point has a base diameter that results in the wide bandwidth, with the monocone antenna having a 5 dBi gain and omnidirectional coverage.

BRIEF DESCRIPTION OF THE DRAWINGS

This invention will be better understood in connection with a Detailed Description, in conjunction with the Drawings, of which.

DETAILED DESCRIPTION

Figure 1:
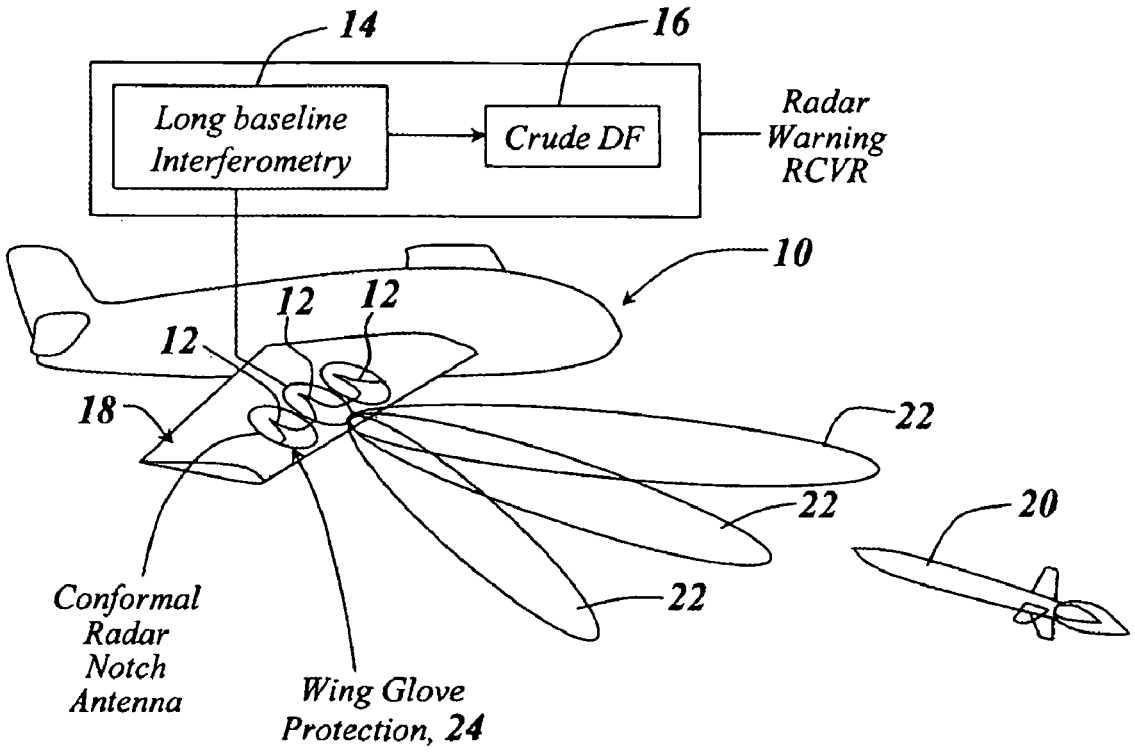
Fig. 1 (Prior Art)
FIG. 1 is a diagrammatic illustration of the utilization of rectilinear notch or Vivaldi notch antennas along the leading edge of a wing of an aircraft to provide crude direction finding based on long-baseline interferometry so as to detect an incoming missile.

Referring now to FIG. 1, an aircraft 10 in the past has been provided with Vivaldi notch or slot antennas here illustrated at 12 which are coupled to a long-base interferometry detection unit 14 which outputs a crude direction finding output at 16 indicating the direction of a source of microwave energy impinging on wing 18.

The microwave energy can come from an on-board radar for an incoming missile 20 which utilizes its radar to search out a target aircraft when the missile is at some distance from the aircraft. It is the purpose of the long baseline interferometric system to determine the direction from which the missile is coming.

Note that with Vivaldi notch antennas, used primarily because of their ultra-wide bandwidth, their main lobes 22 are highly directional, especially at the higher frequencies, making omnidirectional use impractical.

Moreover, in terms of mounting the notch or slot antennas to the wing of an aircraft, it will be appreciated that the airframe structure itself must be varied to accommodate the notch antennas, meaning that the wing skin must be removed at the region of the notch or slot antennas and the structure from the face of the notch rearward must be open so as to accommodate the plates of the notch or slot antenna.

Moreover, when these notches are placed on the leading edge of wing 18, there needs to be a conformal Vivaldi notch wing glove 24 which covers the notches and prevents eroding of the notches and the remainder of the wing from particulate as well as rain erosion. Importantly, the wing glove protection provides a smooth surface to address aerodynamic considerations.

What will be appreciated is that one must design the aircraft wing with the notch or slot antennas in mind, since retrofitting such aircraft with microwave antennas is an expensive proposition.

Additionally for slot antennas, their narrow band operation requires that a number of slot antennas be co-located so as to cover different portions of the electromagnetic spectrum to provide for an ultra-wideband response.

For both slot and Vivaldi notch antennas, antenna gain is well below unity and sometimes as low as −21 dBi.

In order to solve the problem of the costly notch antenna configurations and their inherent problems, both in terms of narrow beamwidth and in terms of gain, in the subject invention a monocone antenna is provided as illustrated by cone 30, which is disposed adjacent a ground plane plate 32 which may be part of the skin of the aircraft. In this case, monocone 30 has an apex 33 to which the center conductor 34 of a coaxial cable 36, is connected to drive the antenna.

The cone itself has a conical surface 37 and a cylindrical surface 38 thereabove, the purpose of which is to extend the length of monocone antenna for the purpose of lowering its low-frequency cutoff.

It is noted that the outer conductor 40 of cable 36 is grounded to ground plane 32.

Figure 3:
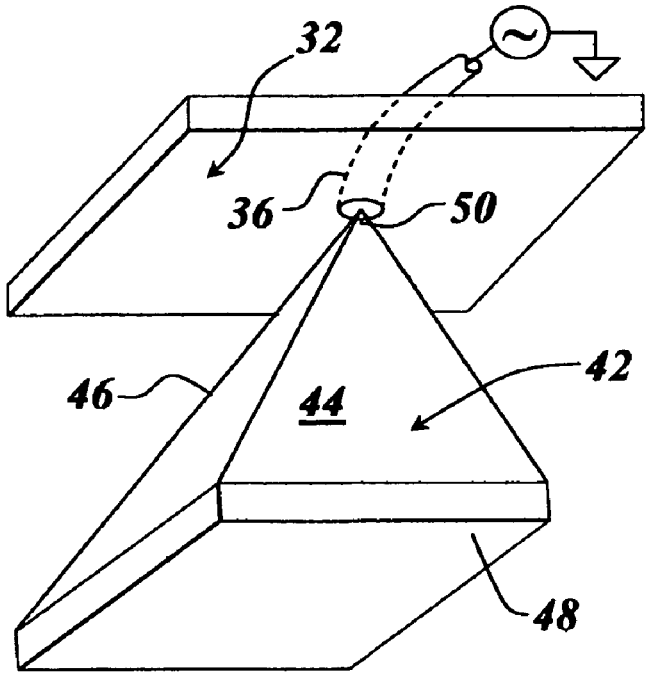
FIG. 3 is a diagrammatic illustration of an alternative cone-shaped monocone antenna in which the cone is a pyramid-type flat-sided structure.

The subject antenna may have alternate configurations including, as illustrated in FIG. 3, the pyramidal type conical configuration such as illustrated at 42, in which the cone has a number of faces, faces 44 and 46 being illustrated.

Figure 2:
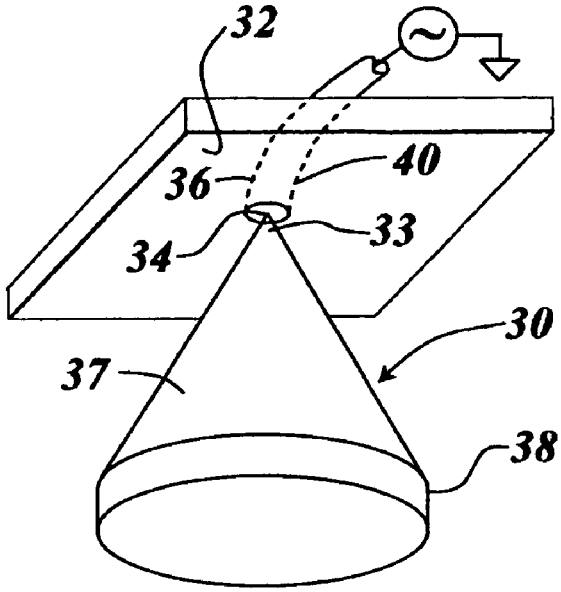
FIG. 2 is a diagrammatic illustration of the subject monocone omnidirectional ultra-wideband low RCS antenna to replace the notch antennas of FIG. 1, showing a cone having its apex adjacent a ground plane, with the cone being fed at the apex thereof.

The pyramidal cone also may have a rectilinear top portion 48, which serves the same function as portion 38 of the FIG. 2 embodiment.

Likewise, apex 50 of cone 42 is spaced from ground plane 32 and is fed by coaxial cable 36 in the same manner as illustrated in FIG. 2.

Regardless of the structure of the cone, be it a smooth surface structure, or one with facets or flat surfaces, it may be made of a solid conductive material or may be hollow.

As will be shown, this type of monocone configuration has an ultra-wide bandwidth going from, in one embodiment, 1 gigahertz to 18 gigahertz, the entire microwave band. Also, it will be shown that the VSWR for such an antenna can be kept below 2:1 and that the gain over the entire microwave bandwidth is in excess of 5 dBi. This is unlike the slot antennas or the Vivaldi notch antennas whose gain at various regions of the electromagnetic spectrum can be as low as −21 dBi.

Figure 4:
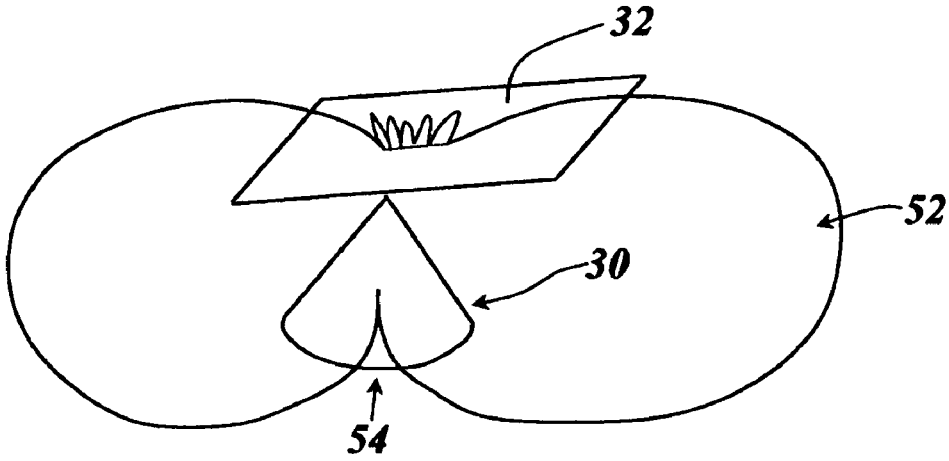
FIG. 4 is a diagrammatic illustration of the antenna pattern of the subject monocone antenna, showing omnidirectionality in the horizontal direction and in all downward directions other than directly beneath the monocone.

With respect to the omnidirectional beam pattern associated with such monocone antennas and referring now to FIG. 4, antenna 30 located beneath a ground plane 32 is shown to have an omnidirectional pattern generally indicated at 52 to be omnidirectional in the horizontal direction and nearly omnidirectional in the downward vertical direction. The only portion not having an omnidirectional characteristic is a rather slim notch illustrated at 54. It will thus be seen that, for radar detection from an aircraft, this antenna is preferable to the notch or slot antennas of FIG. 1.

Figure 5:
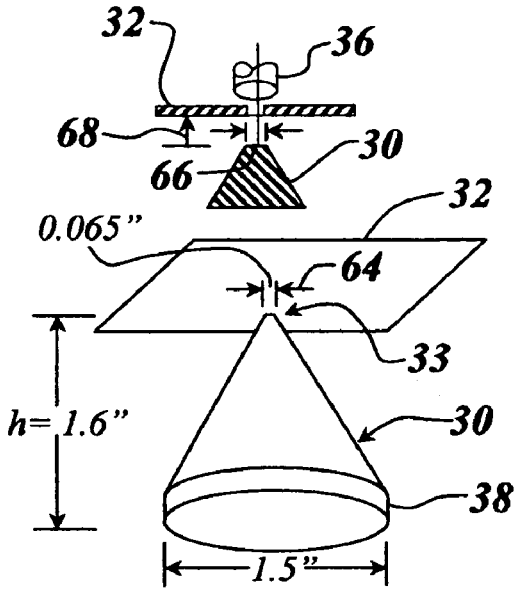
FIG. 5 is a diagrammatic illustration of the dimensions and configurations of a monocone antenna of the subject invention, showing the critical base diameter at the apex of the cone, as well as the height of the cone and its maximum diameter.

Referring to FIG. 5, what makes the antenna so broadbanded is the fact that an apex 33 of a monocone 30 has a base diameter 64 which is set such that its diameter is small enough to provide a low VSWR at the high frequency cutoff of the antenna, in this case 18 gigahertz. As can be seen in cross-section, antenna 30 has a base 66 that is a truncated or flat portion of cone 30, which in one embodiment has a diameter of 0.065 inches. The spacing between the apex base 66 and ground plane 32, as illustrated by arrow 68, is on the order of 0.02 inches. It will be noted that cone 30 has a height of 1.6 inches and the width of its widest section is 1.5 inches.

Figure 6:
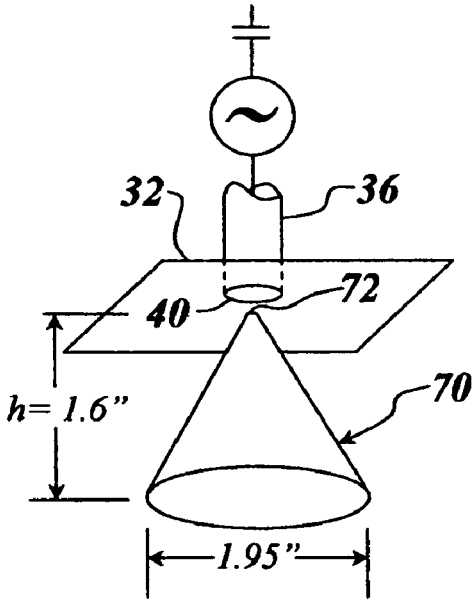
FIG. 6 is a schematic diagram of the antenna of FIG. 5 illustrating the feed of the cone as well as the expanded maximum diameter of the cone.

As can be seen from FIG. 6, a cone 70 configured without the cylindrical portion 38, nonetheless has a height of 1.6 inches, with a diameter of 1.95 inches for its widest portion. Here the antenna is shown fed by coaxial cable 36 at a point 72 by the center conductor of the coaxial cable, with the outer braid 40 being grounded to ground plane plate 32 as illustrated.

In these two embodiments, and indeed in the other embodiments, whether the cone be smooth or having facets, the cone angle, which is the angle from the bottom of the cone vertically, is on the order of 24°–30°.

It will be appreciated that there are many cone configurations and many different dimensions which can lead to an ultra-wideband low RCS antenna, the only requirement being that the apex base be of a small enough size to create a low VSWR at the high frequency cutoff of the antenna.

Figure 7:
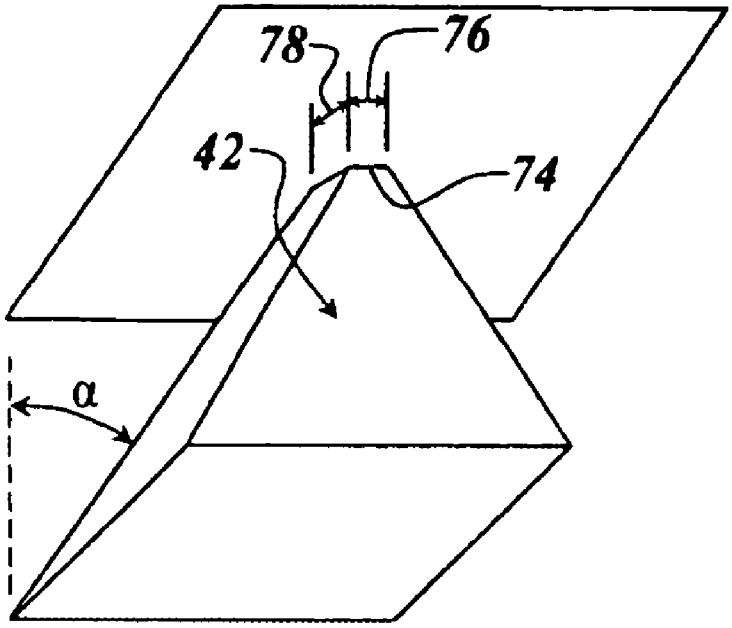
FIG. 7 is a diagrammatic illustration of a pyramid-style monocone antenna showing that the cone angle is the same for this configuration as for that shown in FIG. 5.

Thus, for instance, the antenna could be configured, as illustrated in FIG. 7, to be the pyramidal-type cone 42 but which has a base 74 having dimensions 76 and 78 such that, at 18 gigahertz, for instance, the VSWR is less than 2:1. In one embodiment the dimensions of the base are 0.2"×0.16".

Figure 8:
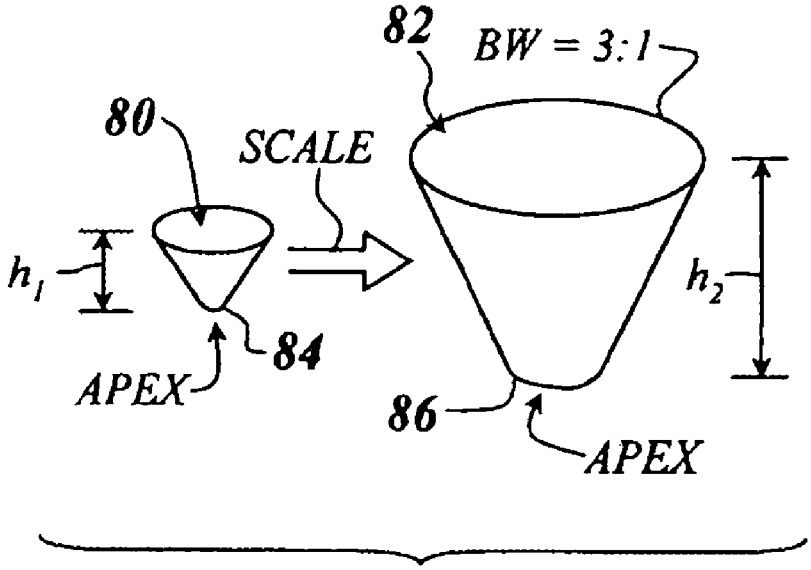
FIG. 8 is a diagrammatic illustration of the direct scaling of a smaller cone to a larger cone so as to lower the low frequency cutoff of the antenna, with the base diameter being scaled as well, but with the bandwidth having only a 3:1 ratio.

Referring to FIG. 8, if one were to simply enlarge a cone 80 and scale it up directly to cone 82 so as to provide a lower frequency cutoff for the antenna, the apex 84 of cone 80 would grow proportionally as illustrated by the apex 86 of antenna 82. If such were the case, the antenna would lose its high frequency cutoff and the frequency ratio would be 3:1 as opposed to the desirable 18:1 ratio.

Thus, mere scaling of an antenna to increase its size in order to decrease its low frequency cutoff is not an option, since it has been found that the apex base diameter is critical to the high frequency cutoff of the antenna.

Figure 9:
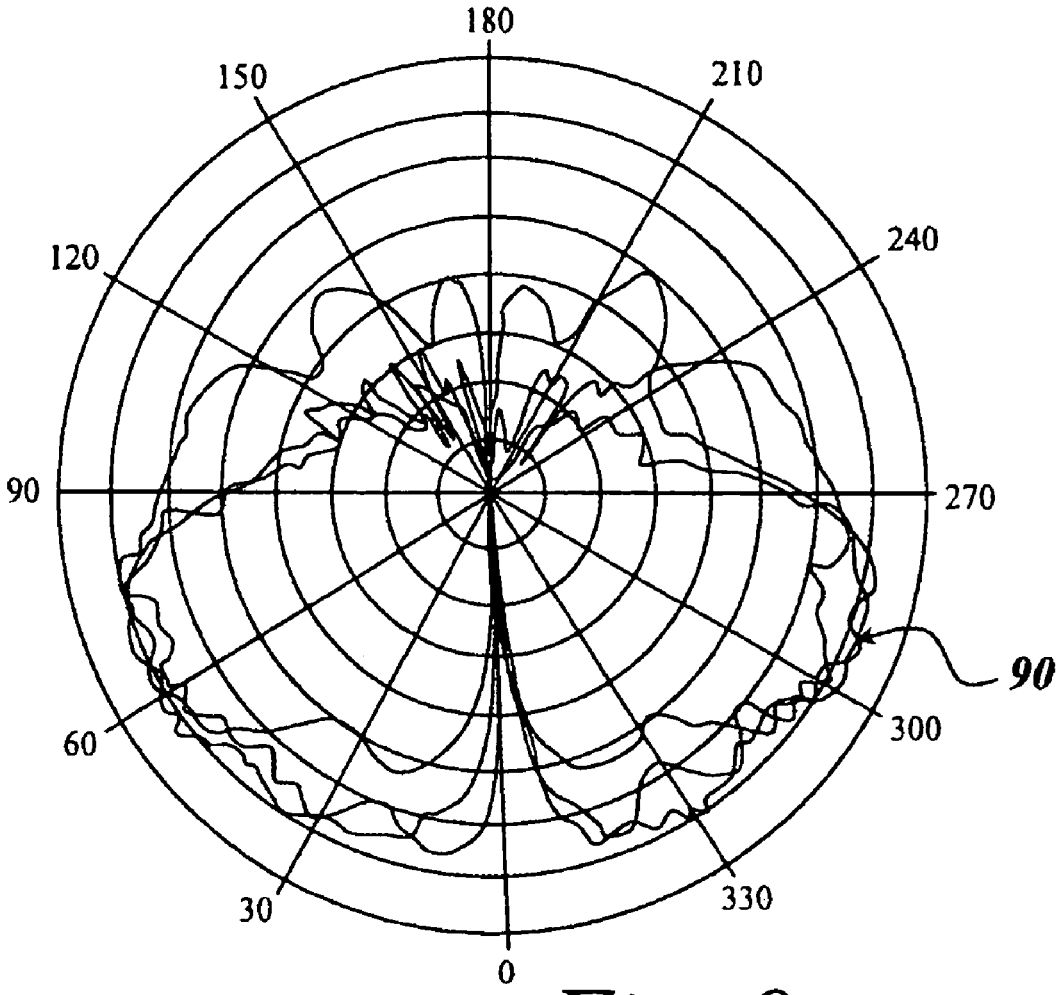
FIG. 9 is a polar plot of the antenna pattern for the antenna of FIG. 2 showing a substantially omnidirectional pattern in the horizontal direction and a substantially omnidirectional pattern in the vertical direction but for a small notch.

Referring to FIG. 9, a polar plot illustrates a measured antenna pattern for the antenna of FIG. 2 at various frequencies from 1 gigahertz to 18 gigahertz. What will be seen is that the antenna pattern 90 is essentially omnidirectional, with the only nondirectional segment being a narrow notch below the cone used to generate this antenna pattern.

Figure 10:
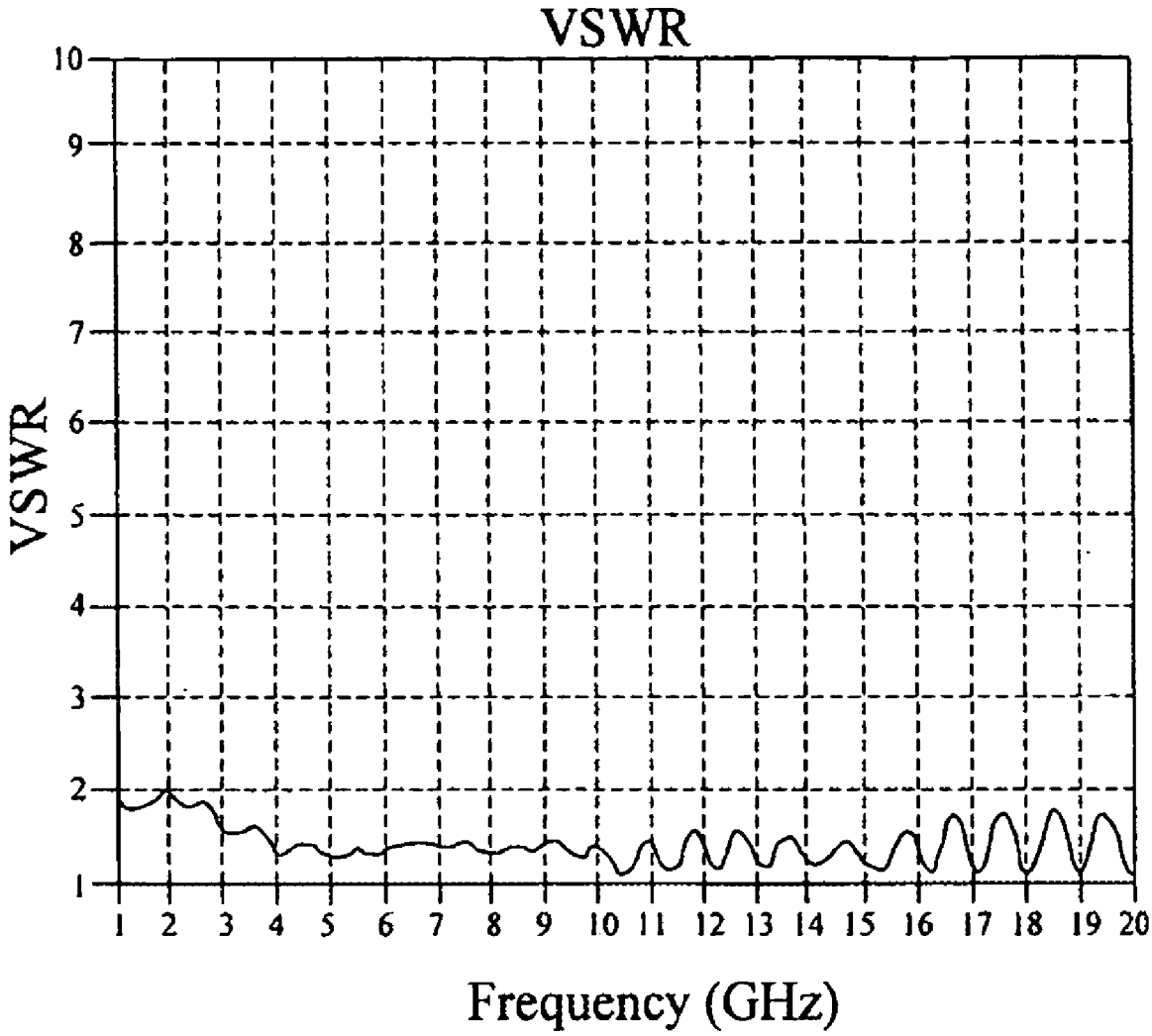
FIG. 10 is a graph showing VSWR versus frequency for the antenna of FIG. 2, showing less than a 2:1 VSWR across the entire band from 1 gigahertz to 18 gigahertz.

Referring to FIG. 10, a graph of VSWR versus frequency indicates that from 1 GHz to 18 GHz, the VSWR is less than 2:1.

It will be appreciated that the monocone antenna has only one polarization and is useful in those applications in which one polarization is acceptable.

Figure 11:
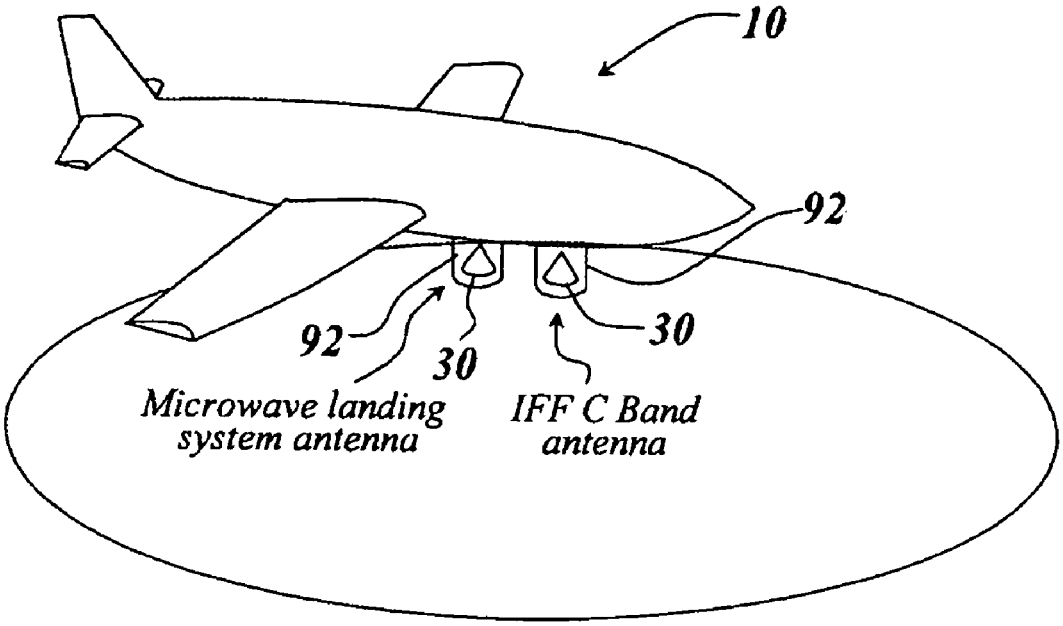
FIG. 11 is a diagrammatic illustration of the location of the subject monocone antenna on the fuselage of the aircraft within a cylindrical radome for either IFF C-band operation or for use in an instrument landing system; and, FIG. 12 is a diagrammatic illustration of the subject antenna located and spaced along a wing so as to provide for long baseline interferometry, with each of the antennas functioning as a point source.

Referring now to FIG. 11, aircraft 10 of FIG. 1 may be provided with the subject monocone antennas 30 virtually anywhere on the fuselage. With the antennas being so small that they are unobtrusive, the antennas may be easily provided with cylindrical radomes 92 if desired. These antennas may be used for IFF C-band purposes or, for instance, for instrument landing systems. These antennas are useful in this context because of the omnidirectional coverage as mentioned above and because of the positive, better than unity gain achievable with the monocone antenna. Again, the wide bandwidth accommodates many IFF and instrument landing situations as well as other surveillance applications.

Figure 12:
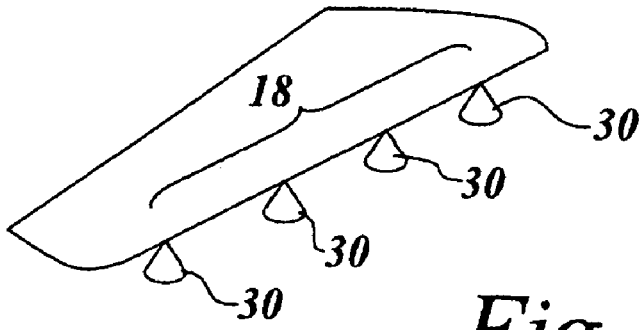

Referring to FIG. 12, wing 18 of aircraft 10 may be provided with a long baseline array of monocone antennas 30 as illustrated such that, with sufficient spacing, these antennas act as point sources and can therefore be used for long baseline interferometry to provide a relatively rough or crude estimate of the direction of the source of incoming microwave radiation. As a result, the use of the antennas can afford advantages due to their omnidirectional coverage, wide bandwidth and small size.

The monocone antenna, in one embodiment, has a 100-watt or better rating so that for jamming purposes this antenna is ideal to be able to project jamming energy of sufficient power to, for instance, countermeasure the radar's incoming missiles.

The antennas, due to their wide bandwidth are also useful for communications purposes or any other purpose involving the microwave region of the electromagnetic spectrum.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for providing an ultra-wide bandwidth monopole antenna having at least a 10:1 frequency ratio, comprising the steps of:

providing a monocone in spaced adjacency to a ground plane;

sizing the height and the cone angle of the monocone to establish a low frequency cutoff;

sizing the apex base of the monocone, to establish the high frequency cutoff of the monocone antenna; and feeding the antenna between the apex and ground plane.

2. The method of claim 1, wherein the cone angle of the monocone is between 24° and 30°.

3. The method of claim 1, wherein the apex base diameter is 0.065".

4. The method of claim 1, wherein the height of the cone is 1.6" and the width of the widest part of the cone is 1.95."

5. The method of claim 1, wherein the cone has a non-conical extension on top thereof, wherein the combined height of the cone and extension is 1.6" and wherein the width of the widest part of the non-conical extension is 1.5."

6. The method of claim 1, wherein the antenna pattern of the monocone antenna is substantially omnidirectional to the side of the ground plane that the cone is located.

* * * * *